US005785604A

United States Patent [19]

Johnson

[11] Patent Number: 5,785,604

[45] Date of Patent: Jul. 28, 1998

[54] PUTTING GUIDE

[76] Inventor: Christopher J. Johnson, 19815 Gary St. NW., Elk River, Minn. 55330

[21] Appl. No.: 879,919

[22] Filed: Jun. 20, 1997

[51] Int. Cl.[6] ..... A63B 69/36

[52] U.S. Cl. ..... 473/265; 273/DIG. 4; 273/DIG. 30

[58] Field of Search ..... 473/257, 258, 473/260, 261, 265; 273/DIG. 30, DIG. 4

[56] References Cited

U.S. PATENT DOCUMENTS 4,437,669 3/1984 Pelz ..... 473/265

5,320,355 6/1994 Johnson ..... 473/265

*Primary Examiner*—George J. Marlo

*Attorney, Agent, or Firm*—Westman, Champlin & Kelly, P.A.

[57] ABSTRACT

The present invention is a putter guide for guiding a putter blade during a putting stroke. A first elongate member has a first end and a second end. The second end defines an aperture extended therein. A second elongate member has a first end and a second end. The second end defines an aperture therein. A unitary member has a first end and a second end. Each end of the unitary member has an outer dimension sized to frictionally fit into the apertures of the second ends of the first and second elongate members. Both the first and second elongate members and the unitary member are formed of flexible cellular polyethylene.

16 Claims, 1 Drawing Sheet

PUTTING GUIDE

BACKGROUND OF THE INVENTION

The present invention deals with golf. More particularly, the present invention deals with a guiding apparatus for guiding a putter blade through a putting stroke.

Putting is a very important component in the game of golf. In order to establish a desirable putting stroke, it is required that the blade of the putter be brought straight back, and straight forward, through the ball, finishing toward the target. It is also very important in a good putting stroke that the golfer's head be held very still, in a fixed position, with the golfer's eyes either looking at the golf ball being struck, or at a point slightly forward of the golf ball.

Therefore, it is difficult when putting (even when only practicing) to determine whether the blade of the putter is going straight back, and finishing straight through the ball toward the hole (or the target). If the golfer's head moves to watch the putter blade during the stroke, the rest of the putting stroke can be affected. Thus, even if the putter blade is going straight back when the golfer is watching it, the blade may not be going straight back and coming straight forward when the golfer is actually looking at the golf ball and exercising the normal putting stroke.

Muscle memory also plays a large part in developing a good putting stroke. It is widely believed that, through hours of practice, muscles can actually be taught to reliably repeat the same stroke. Therefore, by practicing a mechanically sound putting stroke, the golfer can obtain consistency in the putting stroke to become a better overall golfer.

There are prior systems which assist in achieving muscle memory for putting. However, these systems are often very cumbersome, having four or more pieces. In addition, some systems have rigid set-ups which are bulky and not easily carried in a golf bag.

Thus, there is a continuing need for improved devices which can be used while practicing putting to develop a good putting stroke, and which can be easily assembled, disassembled and stored in a golf bag.

SUMMARY OF THE INVENTION

The present invention is a putter guide for guiding a putter blade during a putting stroke. A first elongate member has a first end and a second end. The second end defines an aperture therein. A second elongate member has a first end and a second end. The second end defines an aperture therein. A unitary member has a first end and a second end. Each end of the unitary member has an outer dimension sized to frictionally fit into the apertures of the second ends of the first and second elongate members. Both the first and second elongate members and the unitary member are formed of flexible cellular polyethylene.

DETAILED DESCRIPTION OF THE PREFERRED EMBODIMENTS

Figure 1:
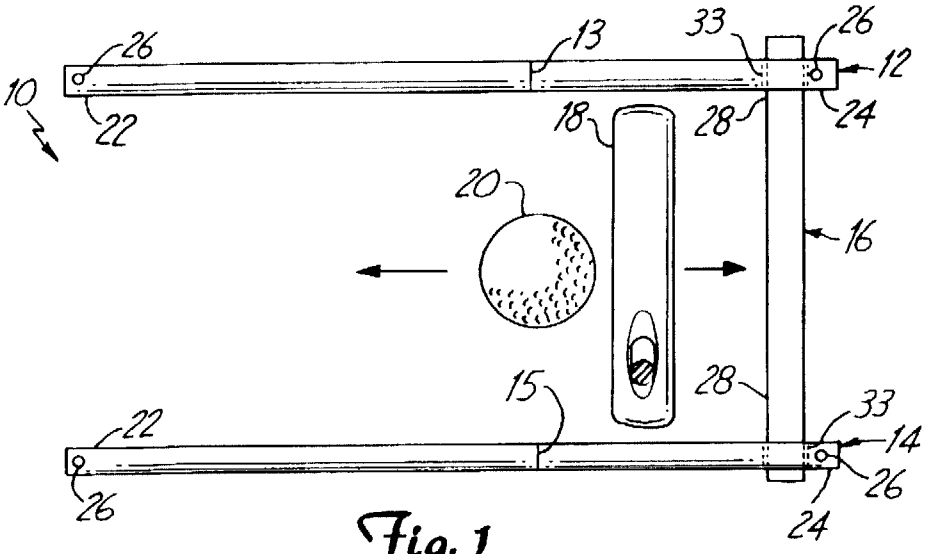
FIG. 1 is a top view of a putter guide of the present invention.

FIG. 1 is a top view of putter guide 10 of the present invention. Putter guide 10 includes first elongate member 12, second elongate member 14, and cross-member 16. Putter guide 10 is shown disposed about a putter blade 18 and a golf ball 20.

First and second elongate members 12 and 14, in this preferred embodiment, are extruded flexible cellular polyethylene members. In one embodiment, elongate members 12 and 14 are formed of cross-linked or lineal cell polyethylene having a density of approximately 1–20 pounds/cubic foot and even more preferably having a density of approximately 3–4 pounds/cubic foot. Elongate members 12 and 14 are preferably approximately 24 inches in length.

Each of elongate members 12 and 14 have first ends 22 and second ends 24. First and second ends 22 and 24 each have an aperture 26 extending from the top of the associated elongate member through the entire width (or thickness) of the elongate member. Apertures 26 are sized to permit a peg to be driven through apertures 26 and into a putting green so that elongate members 12 and 14 may be secured in place during use.

In one preferred embodiment, apertures 25 are sized to receive one end of a golf tee, but to preclude passage of the entire golf tee all the way through the aperture. In this way, a golf tee can be driven down into the putting green through apertures 26 and snugly secure elongate members 12 and 14 to the green so that they do not move during use.

Elongate members 12 and 14 each have a second aperture 33 in their second ends 24. This second aperture 33 is used in conjunction with cross-member 16.

Cross-member 16, in this preferred embodiment, is also an extruded flexible polyethylene member, preferably formed of cross-linked or lineal cell polyethylene having a preferred density of approximately 1–20 pounds/cubic foot and even more preferably having a density of approximately 3–4 pounds/cubic foot. Cross-member 16 has an outer peripheral dimension at its ends 28 sized so that they can be pressed into the second aperture 33 in the ends 24 of elongate members 12 and 14. In this way, cross-member 16 holds elongate members 12 and 14 in spaced relation to one another for ease of configuration during use.

Once putter guide 10 is secured in position, golf ball 20 is placed between elongate members 12 and 14. Elongate members 12 and 14 have indicia 13 and 15 placed on them. Indicia 13 and 15 are generally aligned with one another when putter guide 10 is configured. Indicia 13 and 15 provide a marking so that ball 20 can be repeatedly placed within guide 10 in approximately the same position relative to cross-member 16. In this embodiment, indicia 13 and 15 are located approximately 15 inches from cross-member 16.

The space between elongate members 12 and 14 is increased (or decreased) to a distance which accommodates the length of putter blade 18. This distance is adjusted simply by sliding elongate members 12 and 14 along cross-member 16 relative to one another in the desired direction. Elongate members 12 and 14 then guide the linear motion of putter blade 18 straight back and straight through ball 20 towards a designated target.

Figure 2:
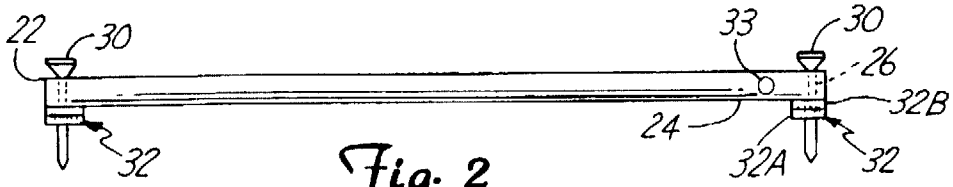
FIG. 2 is a side view of one elongate member of the putter guide shown in FIG. 1.

FIG. 2 is a side view of elongate member 12. FIG. 2 shows golf tees 30 inserted within apertures 26. Golf tees 30 can be driven into a putting green to secure elongate member 12 in place.

FIG. 2 also shows hook and loop fabric 32 secured to the first side 22, and second end 24 of elongate member 12. Hook and loop fabric 32 includes portions 32A and 32B. Portion 32B is the hook portion and portion 32A is a corresponding loop portion. Therefore, when portions 32A and 32B are placed adjacent one another, they adhere to one another in a known manner. However, when putting guide 10 is being used on carpeting, loop portion 32A is removed from the hook and loop fabric. This exposes the hook portion 32B to the carpeting. The hook portion secures itself, in a known manner, to the carpeting, thereby securing elongate member 12 in place on the carpeting.

When putter guide 10 is used on carpeting, golf tees 30 are removed and are not needed. However, hook and loop fabric portions 32 each have an aperture, generally aligned with apertures 26. In this way, the hook and loop portions 32 can be left in place even while putter guide 10 is used on a putting green. The tees 30 are simply inserted through the apertures 26, and through the apertures in hook and loop fabric 32 which are aligned with apertures 26. Thus, putter guide 10 is easily adaptable for indoor and outdoor use.

FIG. 2 also shows aperture 33 in a second end 24 of elongate member 12. Aperture 33 has a diameter which is slightly smaller than the outer diameter of the ends 28 of cross-member 16. The polyethylene material of cross-member 16 is resiliently compressible so that ends 28 may be inserted into the apertures 33 in ends 24 of elongate members 12 and 14. In this way, ends 28 can be forcibly inserted into, and removed from, aperture 33 to connect and disconnect cross-member 16 with elongate member 12.

Figure 3:
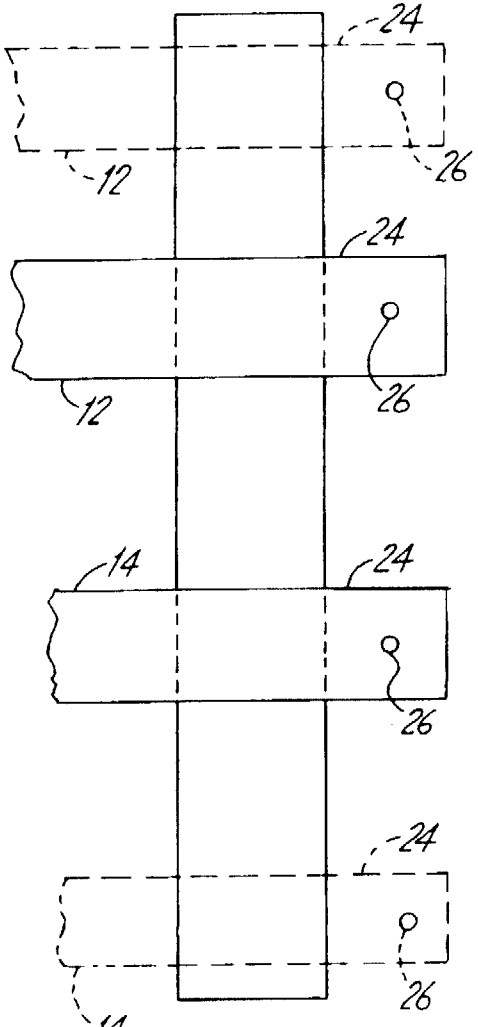
FIG. 3 is an enlarged view of a cross-member of the putter guide shown in FIG. 1.

FIG. 3 is an enlarged view of cross-member 16. FIG. 3 shows cross-member 16 with elongate members 12 and 14 positioned closely proximate one another. Cross-member 16 is preferably approximately ten to twelve inches long.

FIG. 3 also shows (in phantom) a cross-member 16 with elongate members slid away from one another along cross-member 16 and thus positioned further from one another.

In conclusion, the present invention provides a very lightweight, easily portable putting guide which is also very easy to assembly and disassemble. Unlike prior art structures, which have a bulky frame, and which are made of heavier material, the present invention can easily fit into a golf bag and be carried with little extra effort. In addition, the present invention has means for securing the elongate members 12 and 14 to a putting surface, whether that surface is carpeting or grass. Thus, the present invention provides a mechanism for achieving optimal muscle memory and improving a putting stroke.

Although the present invention has been described with reference to preferred embodiments, workers skilled in the art will recognize that changes may be made in form and detail without departing from the spirit and scope of the invention.

What is claimed is:

1. A putter guide for guiding a putter blade during a putting stroke, comprising:

a first extruded flexible cellular polyethylene elongate member having a first end and a second end, the second end having an aperture extending into the second end;

a second extruded flexible cellular polyethylene elongate member having a first end and a second end, the second end having an aperture extending into the second end; and a unitary extruded flexible cellular polyethylene cross-member having a first end and a second end, each end having an outer dimension sized to be frictionally fit into the apertures of the second ends of the first and second elongate members, the cross-member being slidable within the apertures in the second ends of the first and second elongate members to vary the distance between the second ends of the first and second elongate members.

2. The putter guide of claim 1 and further comprising:

fasteners, disposed generally at the first and second ends of the first and second elongate members to fasten the elongate members in place generally parallel to one another and connected by the unitary cross-member.

3. The putter guide of claim 2 wherein the fasteners comprise:

fabric fasteners for fastening the first and second elongate members to carpeting.

4. The putter guide of claim 3 wherein the fabric fasteners comprise:

hook and loop fastening material.

5. The putter guide of claim 2 wherein the fasteners comprise:

pegs sized to fit through apertures formed in the first and second ends of the first and second elongate members and to be driven into a putting green.

6. The putter guide of claim 5 wherein the pegs comprise:

golf tees.

7. The putter guide of claim 1 wherein the first and second elongate members and the cross-member are formed of cross-linked polyethylene having a density of approximately 1–20 pounds per cubic foot.

8. The putter guide of claim 7 wherein the density is approximately 3–4 pounds per cubic foot.

9. The putter guide of claim 1 wherein the first and second elongate members and the cross-member are formed of lineal cell polyethylene having a density of approximately 1–20 pounds per cubic foot.

10. The putter guide of claim 9 wherein the density is approximately 3–4 pounds per cubic foot.

11. An apparatus for use in putting a golf ball, the apparatus, comprising:

a first extruded flexible cellular polyethylene elongate member having a first end and a second end, the second end having a first aperture extending therein;

a second extruded flexible cellular polyethylene elongate member, generally parallel to the first elongate tubular member, having a first end and a second end, the second end having a first aperture extending therein; and a unitary extruded flexible cellular polyethylene cross-member having a first end and a second end, each end having an outer dimension sized to be frictionally fit into the first apertures of the second ends of the first and second elongate members to hold the second ends of the first and second elongate members in spaced relation to one another, the cross-member being sized to slide within the first apertures in the second ends of the first and second elongate members to vary the distance between the second ends of the first and second elongate members.

12. The apparatus of claim 11 wherein the first and second elongate embers have second apertures disposed in the first ends thereof, and third apertures disposed in the second ends thereof, the second and third apertures being sized to receive a peg driven therethrough and into a putting green to anchor the first and second elongate members in place.

13. The apparatus of claim 12 and further comprising:

hook and loop fabric disposed at the first and second ends of the first and second elongate members located to anchor the first and second elongate members to carpeting, the hook and loop fabric defining apertures generally aligned with the second and third apertures to permit insertion of the pegs.

14. An apparatus for use in putting a golf ball, the apparatus, comprising:

a first extruded flexible cellular polyethylene elongate member having a first end and a second end, the second end having a first aperture extending therein, the first aperture having a size;

a second extruded flexible cellular polyethylene elongate tubular member, having a first end and a second end, the second end having a first aperture extending therein, the first aperture having a size; and a unitary extruded flexible cellular polyethylene cross-member having a first end and a second end, each end having a size slightly larger than the size of the first aperture in the first and second elongate members so that the first and second ends of the cross-member are removably insertable into the first aperture of the second ends of the first and second elongate members to hold the second ends of the first and second elongate members in spaced relation to one another, the cross-member being slidable within the first apertures of the second ends of the first and second elongate members to vary the distance between the second ends of the first and second elongate members.

15. The apparatus of claim 14 wherein the first and second elongate members and the unitary cross-member comprise: extruded cross-linked polyethylene.

16. The apparatus of claim 14 wherein the first and second elongate members and the unitary cross-member comprise: extruded lineal cell polyethylene.

* * * * *

UNITED STATES PATENT AND TRADEMARK OFFICE

CERTIFICATE OF CORRECTION

PATENT NO. : 5,785,604

DATED : July 28, 1998

INVENTOR(S) : Johnson

It is certified that error appears in the above-indentified patent and that said Letters Patent is hereby corrected as shown below:

On the title page, insert the following:

Under [56] References Cited, U.S. PATENT DOCUMENTS, insert the following:

| | | | | |
|---|---|---|---|---|
| --2,894,755 | 07/14/59 | Scelzo, Jr. | 273 | 192 |
| 3,868,116 | 02/25/75 | Ford et al. | 273 | 186 |
| 4,544,160 | 10/01/85 | Miner | 273 | 186 |
| 4,620,708 | 11/04/86 | Meyer et al. | 273 | 192 |
| 4,984,802 | 01/15/91 | Barraclough | 273 | 192 |
| 5,014,994 | 05/14/91 | Peters | 273 | 187 R |
| 5,320,355 | 06/14/94 | Johnson | 273 | 192-- |

Signed and Sealed this

Twenty-eighth Day of December, 1999

*Attest:*

*Attesting Officer*

Q. TODD DICKINSON

*Acting Commissioner of Patents and Trademarks*